US007337932B2

(12) United States Patent
Gouldson

(10) Patent No.: US 7,337,932 B2
(45) **Date of Patent: *Mar. 4, 2008**

(54) HANGER BEAM CONSTRUCTION

(75) Inventor: Stanley F. Gouldson, Northport, NY (US)

(73) Assignee: Spotless Plastics Pty. Ltd., Moorabbin, Victoria (AU)

( * ) Notice: Subject to any disclaimer, the term of this patent is extended or adjusted under 35 U.S.C. 154(b) by 0 days.

This patent is subject to a terminal disclaimer.

(21) Appl. No.: 11/178,918

(22) Filed: Jul. 11, 2005

(65) Prior Publication Data

US 2005/0247746 A1 Nov. 10, 2005

Related U.S. Application Data

(62) Division of application No. 10/367,230, filed on Feb. 14, 2003, now Pat. No. 7,104,428.

(51) Int. Cl.
*A41D 27/22* (2006.01)

(52) U.S. Cl. ..... 223/85; 223/96; 223/91; 223/93

(58) Field of Classification Search ..... 52/729.1, 52/729.2, 729.3, 729.5; 223/85, 90, 91, 93, 223/96; D25/126
See application file for complete search history.

(56) References Cited

U.S. PATENT DOCUMENTS

| | | | | |
|---|---|---|---|---|
| 670,027 | A | 3/1901 | Malmberg | |
| 1,843,318 | A * | 2/1932 | Frease | 52/690 |
| 2,049,926 | A * | 8/1936 | Rafter | 52/724.3 |
| 2,108,795 | A * | 2/1938 | Budd | 219/107 |
| 2,487,445 | A | 11/1949 | Johnson | |
| 2,496,531 | A | 2/1950 | Gray | |
| 2,685,354 | A * | 8/1954 | Collins | 52/377 |
| 2,747,704 | A * | 5/1956 | Gorey | 52/377 |
| 2,912,849 | A * | 11/1959 | Wissinger | 52/606 |
| 3,066,394 | A * | 12/1962 | Litzka | 29/564.2 |
| 3,241,285 | A * | 3/1966 | Baroni | 52/729.5 |
| 3,300,839 | A * | 1/1967 | Lichti | 29/897.35 |
| 3,406,883 | A * | 10/1968 | Crane | 223/96 |
| 3,550,784 | A | 12/1970 | Batts | |
| 3,698,043 | A | 10/1972 | Batts | |
| 3,745,616 | A | 7/1973 | Batts | |
| 3,767,092 | A | 10/1973 | Garrison et al. | |
| 3,824,671 | A | 7/1974 | Watkin | |
| 3,859,710 | A | 1/1975 | Batts et al. | |
| 3,923,213 | A | 12/1975 | George et al. | |
| 3,946,915 | A | 3/1976 | Crane | |

(Continued)

FOREIGN PATENT DOCUMENTS

| | | |
|---|---|---|
| DE | 2037995 | 2/1972 |

(Continued)

*Primary Examiner*—Richard E. Chilcot, Jr.
*Assistant Examiner*—Chi Q. Nguyen
(74) *Attorney, Agent, or Firm*—Scully, Scott, Murphy & Presser, P.C.

(57) ABSTRACT

An I-beam having a web curved in two dimensions is used to provide an enhanced stiffness to weight ratio for molded plastic hangers. The I-beam includes first and second generally parallel flanges which extend in a longitudinal direction. The flanges are joined by a curved web, which is defined in part by first and second radii of curvature, wherein the radii are nominally orthogonal to each other.

6 Claims, 6 Drawing Sheets

U.S. PATENT DOCUMENTS 3,949,914 A * 4/1976 Ostroll ..... 223/85
3,973,705 A 8/1976 Erthein
4,009,807 A 3/1977 Coon
4,023,721 A 5/1977 Erthein
4,084,029 A * 4/1978 Johnson et al. ..... 428/119
4,115,940 A 9/1978 Phillips
4,157,782 A 6/1979 Mainetti
4,169,549 A 10/1979 Takagi
4,187,967 A 2/1980 Garrison
4,192,441 A 3/1980 Batts
4,194,274 A 3/1980 Garrison
4,209,879 A 7/1980 Paajanen
4,231,500 A * 11/1980 Mainetti ..... 223/96
4,251,973 A * 2/1981 Paik ..... 52/729.1
4,295,585 A 10/1981 Garrison
4,322,902 A 4/1982 Lenthall
4,349,127 A 9/1982 Savard, Jr.
4,355,743 A 10/1982 Erthein
4,381,599 A 5/1983 Duester et al.
4,383,362 A 5/1983 Graniero et al.
4,395,799 A 8/1983 Batts
D271,649 S 12/1983 Batts et al.
4,446,996 A 5/1984 Garrison
4,565,309 A 1/1986 Batts et al.
4,576,849 A * 3/1986 Gardiner ..... 428/119
4,706,347 A 11/1987 Lindsay
4,718,581 A 1/1988 Chiaramonte
4,734,146 A * 3/1988 Halcomb et al. ..... 156/148
4,826,056 A 5/1989 Duester et al.
4,843,777 A * 7/1989 Shimabukuro ..... 52/729.4
4,871,097 A 10/1989 Blanchard et al.
4,873,878 A 10/1989 Milton
4,892,237 A * 1/1990 Duester et al. ..... 223/85
5,075,935 A 12/1991 Abdi
5,082,153 A 1/1992 Duester et al.
5,096,101 A 3/1992 Norman et al.
D332,180 S 1/1993 Marshall et al.
5,199,608 A 4/1993 Zuckerman
5,238,159 A 8/1993 Zuckerman
D341,947 S 12/1993 Marshall et al.
5,267,678 A 12/1993 Zuckerman
5,272,806 A * 12/1993 Marshall et al. ..... 29/822
5,285,566 A 2/1994 Marshall et al.
5,285,616 A * 2/1994 Tripp ..... 52/729.1
5,400,932 A 3/1995 Hollis
5,412,921 A * 5/1995 Tripp ..... 52/729.2
5,417,022 A * 5/1995 Ritchie ..... 52/309.13
5,507,086 A 4/1996 Marshall et al.
5,516,014 A 5/1996 Garrison et al.
5,568,685 A 10/1996 Marshall et al.
5,573,151 A * 11/1996 Fildan ..... 223/96
5,595,331 A 1/1997 Leistner
5,604,975 A 2/1997 Marshall et al.
5,785,216 A * 7/1998 Gouldson et al. ..... 223/85
5,794,363 A 8/1998 Marshall et al.
5,848,765 A * 12/1998 Gillespie ..... 244/124
6,019,261 A * 2/2000 Morgan et al. ..... 223/96
6,021,933 A 2/2000 Zuckerman
6,050,461 A * 4/2000 Batts et al. ..... 223/96
6,105,836 A * 8/2000 Batts et al. ..... 223/96
6,202,906 B1 * 3/2001 Zuckerman ..... 223/96
6,260,745 B1 7/2001 Gouldson et al.
6,421,910 B1 7/2002 Marshall et al.
6,520,706 B1 * 2/2003 McKague et al. ..... 403/265
7,104,428 B2 * 9/2006 Gouldson ..... 223/85

FOREIGN PATENT DOCUMENTS

EP 0095353 A1 11/1983
EP 0095353 B1 11/1983
EP 0007246 A1 1/1990
FR 2050296 4/1971
WO WO 90/09651 8/1990

* cited by examiner

HANGER BEAM CONSTRUCTION

CROSS-REFERENCE TO RELATED APPLICATIONS

This application claims priority under 35 U.S.C. § 120 as a division of U.S. patent application Ser. No. 10/367,230, filed 14 Feb. 2003 now U.S. Pat. No. 7,104,428, entitled Hanger Beam Construction, by the present inventor Stanley F. Gouldson, now allowed. The complete disclosure of the foregoing application is hereby incorporated by reference in its entirety for all purposes.

FIELD OF THE INVENTION

The present invention relates generally to a novel beam construction that is particularly well adapted for use in molded plastic hangers, and particularly certain types of pinch grip hangers used for hanging pants and skirts for shipment to retailers and display of the same in a retail environment.

BACKGROUND OF THE INVENTION

Consumer taste and fashion have dictated a desire for mass-produced, but well-fitted garments, which are distributed and sold throughout the United States. Large national retailers of clothing generally contract with a plurality of clothing manufacturers to produce uniform standardized clothing, which is essentially identical from batch to batch, even though manufactured by different entities. These manufacturers in turn produce the clothing at their own plants, or in many cases, subcontract the production of the garments to manufacturers based in the Far East, for instance, in Hong Kong, Taiwan, Singapore and South Korea.

In the retail clothing industry clothing is typically suspended from hangers at the point of purchase. Such hangers are often inexpensive ship-on types and under prevailing garment-on-hanger programs, the garment is shipped from the manufacturer to the retailer while suspended from a hanger. Traditional garment-on-hanger pant and skirt hangers use a horizontal beam with grips at either end thereof, normally either a spring clip or a pinch grip. Inasmuch as a variety of clothing articles may be suspended from these hangers, and some articles may be rather heavy, the strength of the beam and the strength to weight ratio of the beam is important. The transoceanic shipment of these hangers and garments subject the hangers to significant inertial loads that arise as a result of sudden movements of the containers transporting the hangers and garments. To best withstand these loads, the stiffness of the hanger is important, for both horizontal deflection and torsional deflection. As a result, a significant factor in the design of the hanger is balancing the weight and cost of the plastic used in the hanger with the beam design and the loads to be carried. Further, many of these hangers are molded at locations remote from the garment manufacturer, and the weight and cube of the hangers to be shipped to a manufacturer is a significant cost factor in determining the price of the hanger. For each of the forgoing reasons, improving the stiffness and strength to weight ratio of the hanger is important.

DISCUSSION OF THE PRIOR ART

The present application discloses a novel hanger beam construction for use in pinch grip hangers that utilize a central beam member suspended from a hook, with a pinch grip at either end thereof. In this construction, a pair of longitudinal flanges extend the length of the beam, and are joined by a web that is curved in two dimensions.

Curved beams are known, in which the flanges of a beam are both curved and the connecting web is curved, wherein the flanges and connecting web together form an arch like structure, such as that taught in U.S. Pat. No. 4,921,159.

The use of an undulating curved web for at least a portion of the web of an I-beam is also known, as taught by the use of a corrugated portion formed in the middle of an I-beam web as taught by U.S. Pat. No. 4,251,973.

U.S. Pat. No. 4,843,777 discloses a wooden synthetic box beam formed with a pair of coplanar flanges, and a plurality of web members, including a pair of curved web plates, secured between the flanges by a connecting bolt that joins the two flanges.

U.S. Pat. Nos. 4,194,274 and 5,082,153 are typical of the clamping hangers referred to above, which used a steel spring to secure the jaws of a clam shell clip together. These hangers, while relatively secure in clamping the garment, require significant physical force to close the clam shell clip of the hanger on a thick waist band. This could result in increased time and labor costs to load the hanger and complaints of inadvertently broken finger nails from retail store personnel, with occasional repetitive stress injury complaints from factory workers who were loading thousands of garments a day into hangers of this style.

U.S. Pat. Nos. 5,400,932, 6,019,261 and 6,021,933 are typical of more recent hanger designs that incorporate a guard to prevent the inadvertent opening of pinch grips during shipment. In these designs, the pinch grip with a fixed and a moveable jaw is used, with the fixed jaw integrally molded with the hanger support bar. One or more guard members then extend outwardly from the support bar to protect the moveable jaw from inadvertent actuation. While these designs achieve their intended effect, they are relatively thick, reducing the number of hangers that can be shipped on any given support bar. Further, as a result of the pinch grip design utilized, the maximum opening of the pinch grip is limited.

SUMMARY OF THE INVENTION

The invention provides an inexpensive pinch grip hanger with a novel beam construction to enhance the strength and rigidity of the hanger during normal use.

The invention provides an inexpensive pinch grip hanger with a novel beam construction having an improved strength to weight ratio and reduced width that will allow greater density of garments during shipment.

The invention provides an inexpensive pinch grip hanger with a novel beam construction and a nesting configuration to reduce the weight, cube and resultant costs associated with shipment of the hanger, while maintaining the strength and rigidity of the hanger during normal use.

The invention provides an inexpensive secure pinch grip hanger with a novel beam construction having reduced width and guards to prevent inadvertent actuation of the pinch grips and allow greater density of garments during shipment.

The invention also provides a secure and protected pinch grip hanger having a novel beam construction and reduced width having a relatively wide jaw opening to facilitate insertion of garments.

Accordingly, a pinch grip hanger having a novel beam construction is provided. The novel beam includes first and second flange members which extend the length of the hanger from a centrally located hook to novel pinch grips at either end thereof. The flanges of the beam are joined by a curved web, which improves the strength and torsional rigidity of the hanger. The curvature of the web may also be used to form offset mounting points for the pinch grips that do not lie in a central plane defied by the hanger hook. This curvature and offset mounting enables the hanger to be constructed with reduced width, which enables greater density during use, and enables nesting of the hangers, which provides greater density and reduced cube during initial shipment, before the hangers are loaded with garments.

In a preferred version of the novel beam of the present invention, the curved web is curved in two dimensions. Curvature in two dimensions provides enhanced strength and rigidity for the beam of the hanger, enabling a reduction in the weight of plastic required for a given weight of garment.

A particularly rigid but yet esthetic hanger beam is formed when a cylindrical axii of the radii of the curves are orthogonal to each other, and the radii are constant along the length of the hanger beam.

Thus the present invention provides an improved pinch grip hanger having a hook and a support bar suspended from said hook with the support bar defining a horizontal axis, with a pinch grip mounted on either end of the support bar. Each of the pinch grips define a first depth in a direction perpendicular to said horizontal axis. Each of the pinch grip has a first and a second pinch grip jaw, with the first jaw mounted on and integrally molded with the support bar at a fixed location. The second jaw is pivotally mounted on said first jaw and spring biased into engagement with said first jaw. The second jaw has a user engagement portion extending upwardly from the pivotal mounting, and a garment engaging portion extending downwardly from said pivotal mounting. The user engagement portion enables a user to open the pinch grip for insertion or release of a garment in said pinch grip. A multi-stage spring encompasses the first and second jaws and bias the pinch grip to a closed position to clamp and suspend a garment between said first and second pinch grip jaws in normal use.

The hanger further includes an offset mounting portion securing the first jaw of the pinch grip to the horizontal support bar, such that said first pinch grip jaw is offset from the centerline of the hanger by approximately one half the distance of the first dept, thereby reducing the depth of the hanger in normal use.

DETAILED DESCRIPTION OF THE PRESENT INVENTION

Figure 1:
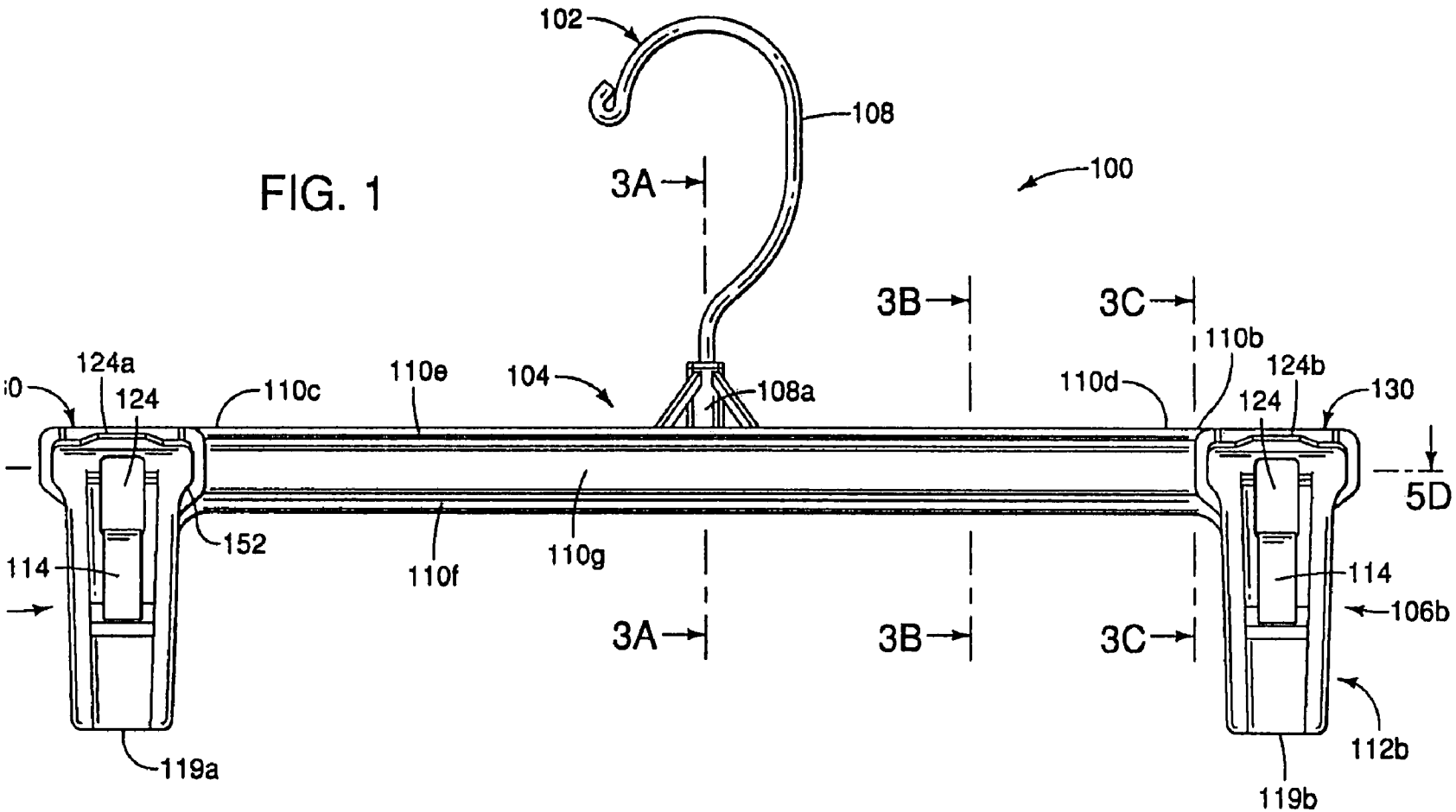
FIG. 1 is a front plan view of a pinch-grip hanger with a body member formed from the curved I-beam of the present invention, with a metal wire hook member rotatably disposed in the body of the hanger.

The improved pinch grip hanger of the present invention is illustrated in plan view in FIG. 1, with FIG. 1 being a plan view of the front side of a first embodiment of the hanger. The improved pinch grip hanger 100 is molded of plastic with a body member 104 formed by a center support bar 110 and an upwardly extending hook member 108. As illustrated in FIG. 1, the hanger is fitted with a wire metal hook 108 that is swivel mounted in the central support bar 110 in a manner well known in the art. As illustrated in FIG. 1, the pinch grip hanger includes a first 106*a* and second 106*b* pinch grip positioned on either end of the support bar 110. In the embodiment illustrated in FIG. 1, the central support beam 110 is molded in plastic to create a novel I-Beam having a web curved in two dimensions.

Figure 3C:
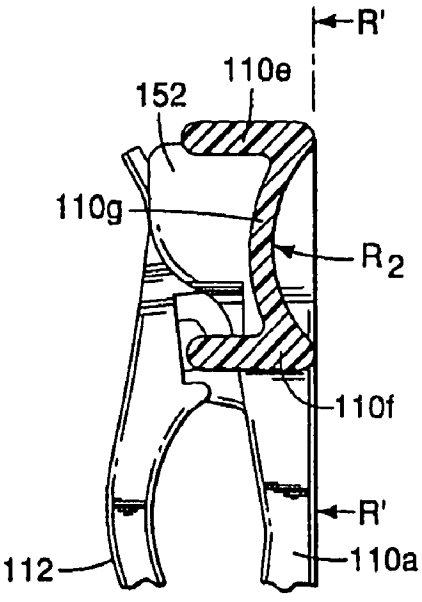
FIG. 3C illustrates a partial sectional view of the pinch-grip hanger of FIG. 1 taken along section line 3C-3C in FIG. 3A.
Figure 3B:
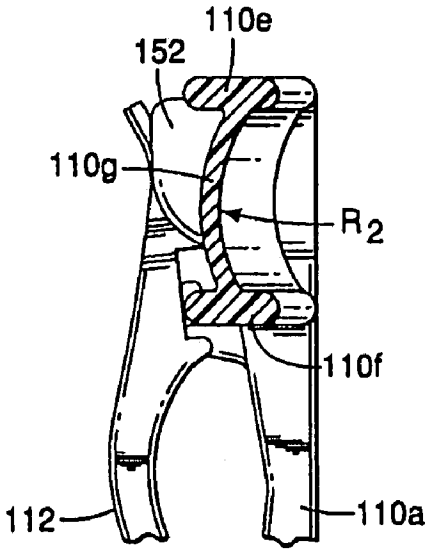
FIG. 3B illustrates a partial sectional view of the pinch-grip hanger of FIG. 1 taken along section line 3B-3B in FIG. 1.
Figure 3A:
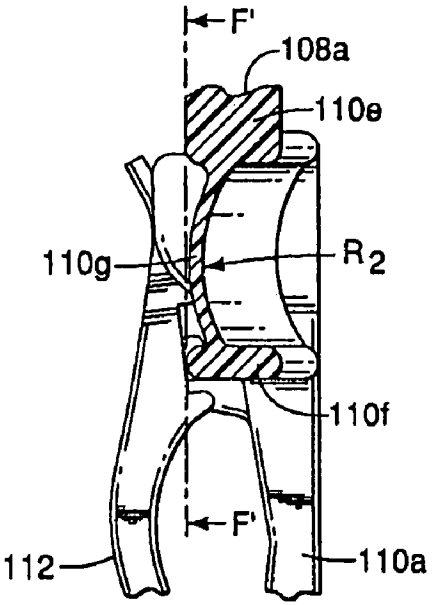
FIG. 3A illustrates a partial sectional view of the pinch-grip hanger of FIG. 1 taken along section line 3A-3A in FIG. 1.
Figure 5:
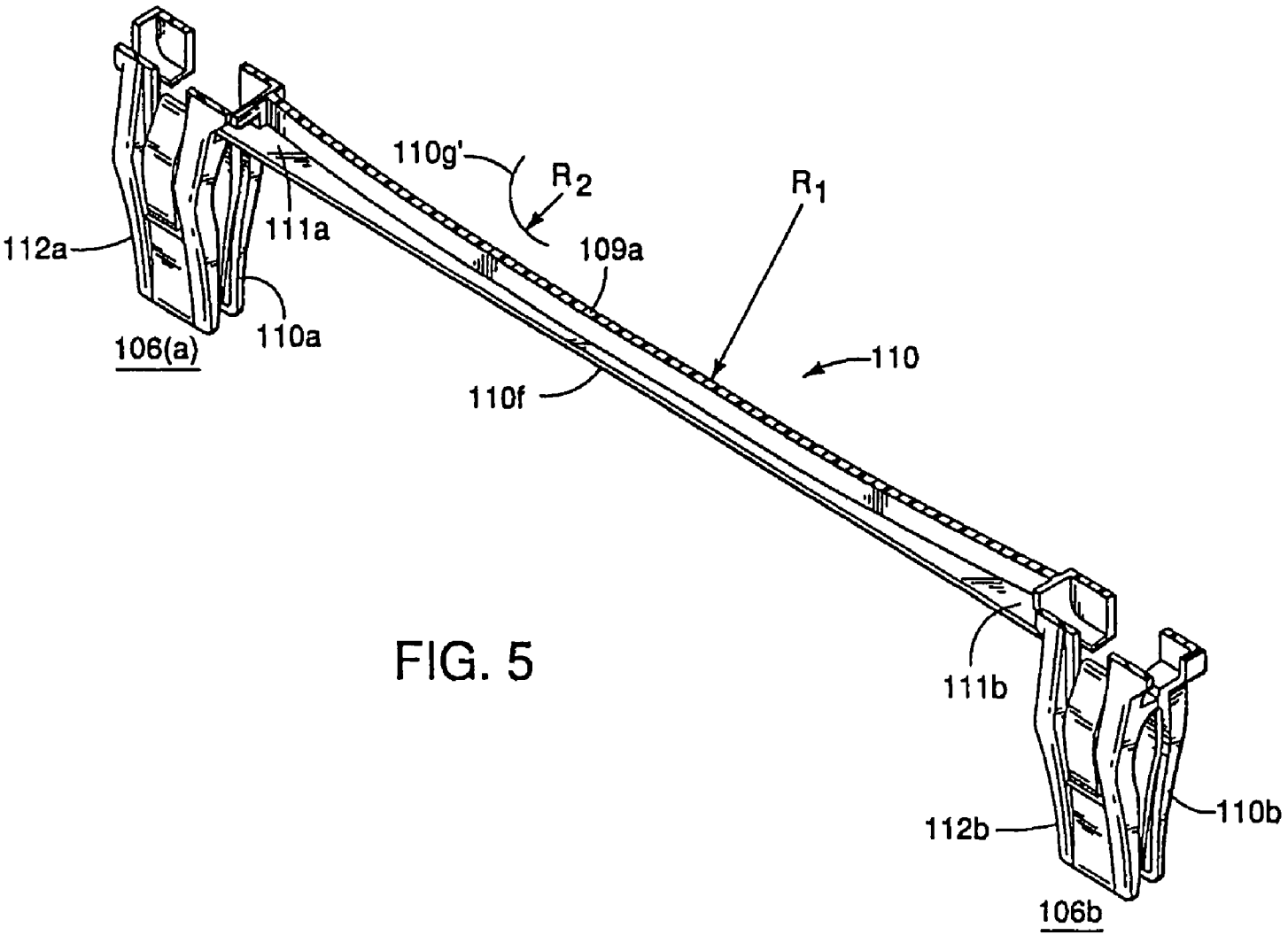
FIG. 5 illustrates a partial isometric sectional view of the pinch-grip hanger of FIG. 1 taken along section line 5D-5D in FIG. 1.

Hanger 100 is suspended from a hook 108 at mid point, and has pinch grips 106*a*, 106*b* at either end 110*c*, 110*d* of the beam 110. The novel beam includes a first 110*e* and second 110*f* longitudinal flanges joined by curved web 110*g*. Fixed jaws 110*a*, 110*b* are integrally molded at either end of the hanger beam 110. For purposes of illustration, the hanger beam 110 is sectioned longitudinally and transversely along axis 5D-5D, which section is illustrated in FIG. 5. Hanger beam 110 is also sectioned vertically at section lines 3A-3A, 3B-3B and 3C-3C, which sections are represented in FIGS. 3A, 3B and 3C respectively.

Figure 2:
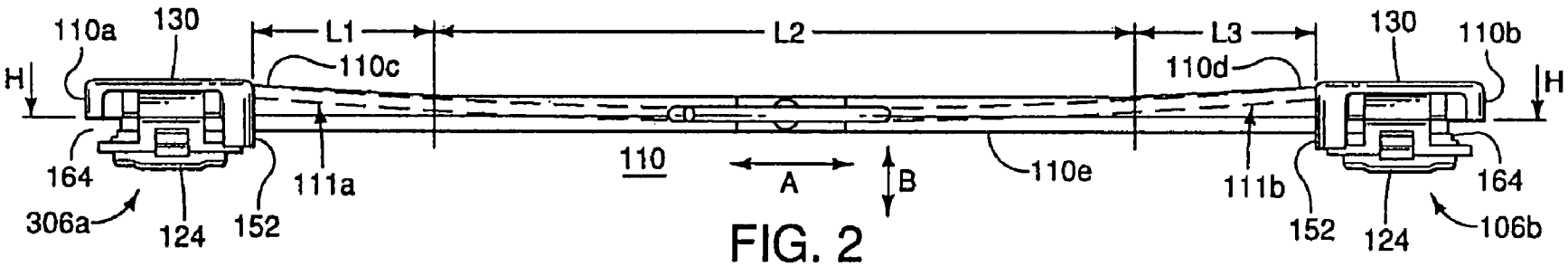
FIG. 2 illustrates a top view of the pinch-grip hanger of FIG. 1, illustrating an offset mounting of the pinch grips achieved with a the improved hanger beam.
Figure 4:
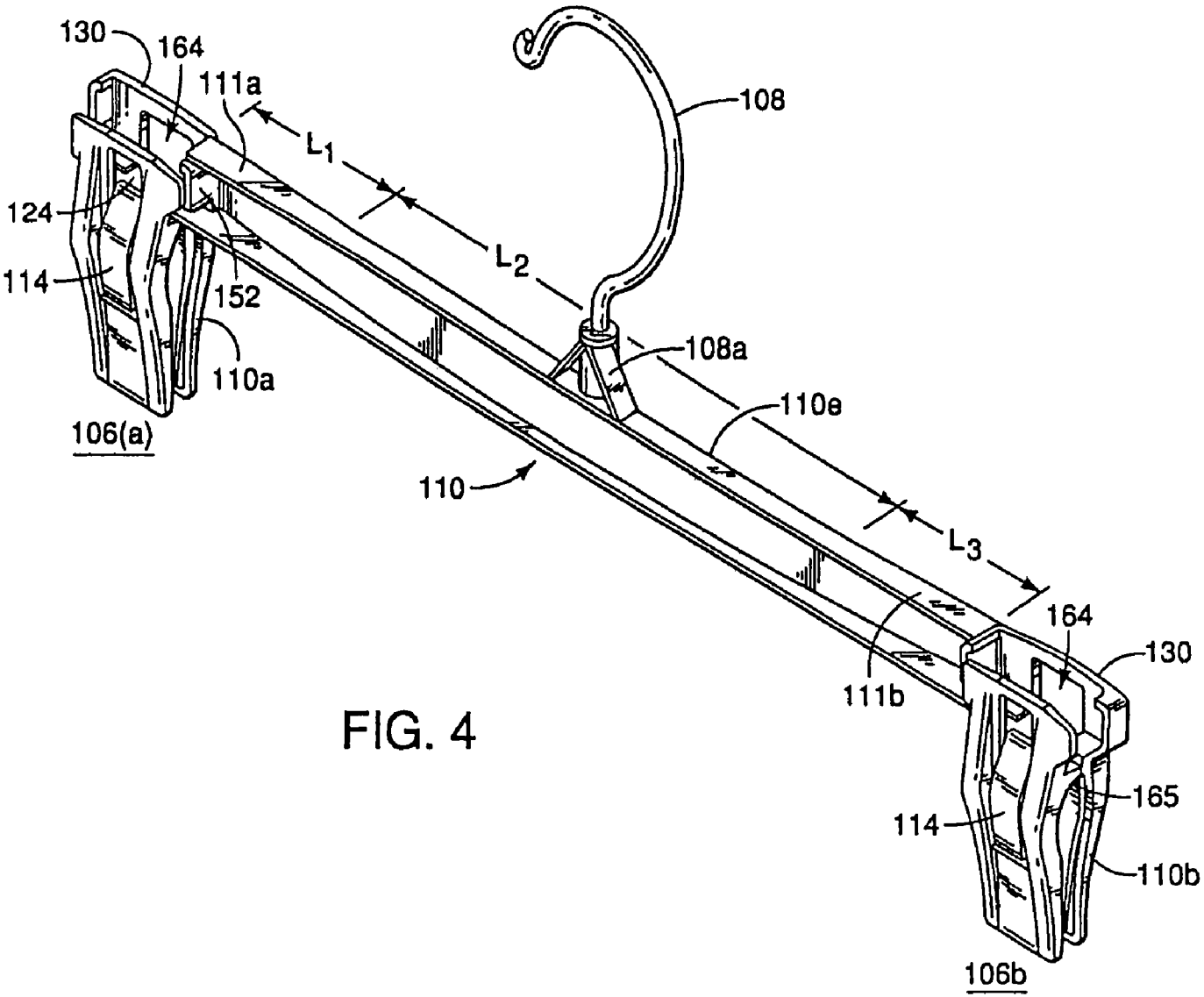
FIG. 4 is an isometric view of the pinch-grip hanger of FIG. 1 illustrating the novel beam construction.

In the pinch grip hanger illustrated in FIGS. 1 and 2, the body 104 of the hanger is integrally formed of plastic with first and second flanges 110*e*, 110*f* of a support beam 110 being generally parallel to each other, with fixed pinch grip jaws 110*a*, 110*b* integrally molded with said support beam or bar 110 at first and second ends 110*c*, 110*d* of said beam, and the second pinch grip jaws 112*a*, 112*b* secured thereto by a resilient springs 114 along a pivot axis that may be seen at 165 in FIG. 4.

As illustrated in FIG. 2, a curved web member 110*g* joins the flange members 110*e*, 110*f* and extends from the first jaw member 110*a* on one side of a center axis H-H' of said hanger beam 110 to an opposite side of said center axis H-H' at said hook member 108. This enables the curved web member 110*g* and said flanges 110*e*, 110*f* to support an offset mounting of a guard member 152 and offset mounting of the pinch grips 106*a*, 106*b* with respect to the center axis H-H' of the support bar 110, such that said first pinch grip jaw 110*a* is offset from the center axis of the hanger H-H' by approximately one half the depth of the arc of said curved web to thereby reduce the depth of the hanger in normal use, as best illustrated at 111*a*, 111*b* in FIG. 4.

Figure 8:
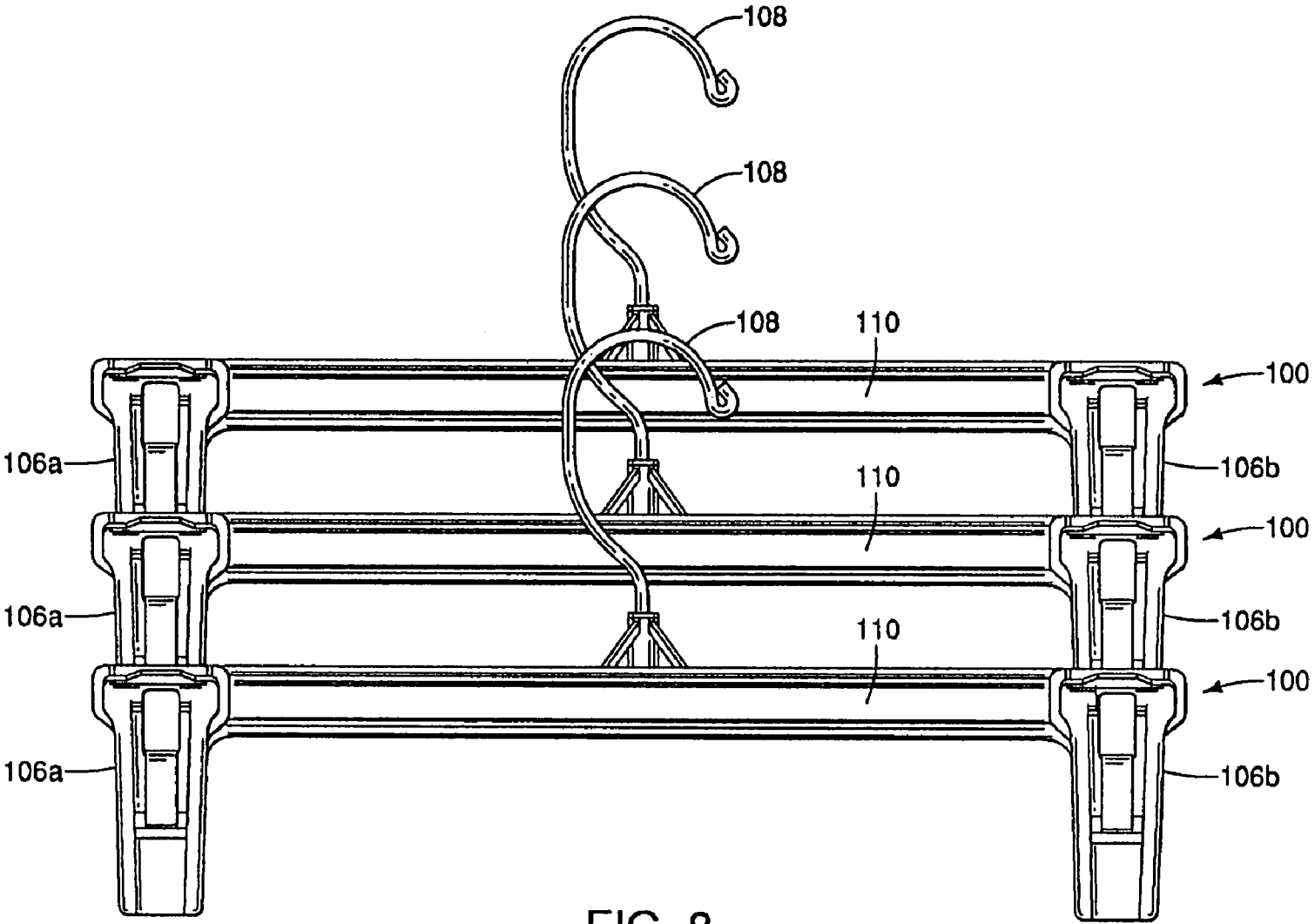
FIG. 8 illustrates a plurality of the hangers of the present invention nested in a stack of hangers to lower the cube cost of shipping the hangers before use.

The pinch grip hanger 100 may also be nested with other pinch grip hangers, as the pinch grip ends 119*a*, 119*b* are dimensioned and configured to nest between the user engagement portion 124 and the rear wall 130 of the pinch grip jaw 110*a* of a similar hanger, as illustrated in FIG. 8, and as more fully described in co-pending U.S. application Ser. No. 10/431,094, filed contemporaneously herewith, and incorporated herein by reference thereto. As described therein, the garment engagement portions 119*a*, 119*b* of a first of said improved pinch grip hangers is receivable in a pocket or user actuation portions 164 of a second of said pinch grip hangers to nest the hangers.

In conventional I-beam construction, elongated first and second parallel flanges are joined by an interconnecting web. In conventional engineering analysis, the contribution of the web to the supportive and deflexive strength of the I-beam is minimal, compared to the strength imparted by the first and second flanges, particularly when the beam is supported at mid-point by a hook, and loads are imposed on either end thereof by pinch grips molded thereto which support garments suspended therefrom. In molded plastic articles, such as plastic hangers, the weight and cost of the plastic used for the interconnecting flange is not insignificant, particularly when the web is bulked up to add torsional stiffness. From an engineering analysis, the central web, near the neutral zone of the hanger, does not contribute significantly to torsional stiffness, except as a component in the flexure of the angles it forms with the flanges.

The present invention moves the interconnecting web material out of the neutral axis of the I-beam, and closer to the cylindrical shear/strain axis that resists torsional stress. In the preferred embodiment, this is done by curving the web in two dimensions, with the cylindrical axii of the two curves nominally orthogonal to each other. This embodiment also distributes the material equally on either side of the parting line of the mold, thus enhancing the moldability of the hanger.

While the preferred embodiment of the invention uses orthogonal cylindrical axii and constant radii to create a esthetically pleasing structure (shown in FIG. 1) that has significantly enhanced strength and stiffness, it is not necessary that the cylindrical axii be constant or orthogonal if design conditions dictate otherwise. These characteristics are most suitable to a beam of relatively constant dimension, such as the hanger beam 110 illustrated in FIG. 1. When applying the present invention to non-uniform structures, such as the hanger illustrated in FIG. 6, it may be desirable or necessary to vary the cylindrical axii or radii accordingly.

As illustrated in FIG. 5, hanger 100 is illustrated in isometric section, as sectioned along axis 5D-5D of FIG. 1. The front of the hanger is presented, with lower longitudinal flange 110*f* of I-beam 110 joining pinch grips 106*a* and 106*b*. The interconnecting web 110*g* is shown in cross section, with a first cylindrical axis R1 transverse to the longitudinal axis of flange 110*f*. The second cylindrical axis is diagrammatically represented at R2, which cylindrical axis is transverse to R1, and curved along R1 in the longitudinal direction of flange 110*f*.

As indicated previously, in the preferred embodiment illustrated in FIG. 1, both R1 and R2 are of constant radii along the length of the beam 110. This provides an improvement in torsional stiffness over a conventional I-beam construction, improves stiffness to lateral deflection, and maintains strength in the primary load vertical axis. It also provides an esthetically pleasing curved shape when formed in clear plastic as illustrated in FIG. 1, with the direction of curvature not immediately apparent upon viewing. A close examination however will reveal the curvature of web 110*g*, primarily at the ends, as flange 110*f* becomes increasingly apparent towards the ends of the hanger. The curvature of R2 also becomes apparent at the ends 110*c*, 110*d* as better illustrated in FIG. 3C. FIGS. 3A-3C illustrate R2, which varies in its relationship to flanges 110*e* and 110*f* according to its position along R1. At the center of the hanger, illustrated in FIG. 3A, the curve of R2 is tangent at its most forward part to an axis F-F' which is drawn between the front edges of flanges 110*f* and 110*g* in FIG. 3A, with the mounting block 108*a* for hook 108 being partially visible in section.

Along the mid point of curvature of R1, on either side of the center of the hanger illustrated at section line 3B-3B, the web 110*g* is centrally positioned between the flanges 110*e* and 110*f* as illustrated in FIG. 3B.

At the end points of curvature of R1, which occur where the beam 110 merges into the fixed clips 110*a*, 110*b*, the rearward most points of R2 are chorded by an axis R-R' as illustrated in FIG. 3C, wherein axis R-R' is drawn between the back edges of flanges 110*f* and 110*g*. The esthetic limits of curvature are thus defined by the width of the beam as the ends of an arc on the concave side, and the apex of the arc on the convex side.

It should be noted that one could, in a molded environment, flow the edges of the flanges into the ends of the arc on the front or convex side and achieve an improvement in torsional rigidity. Likewise, one could vary the width of the flanges of the I-beam along the length to further extend the curvature of R1 on the concave side of the arc, as has been done in hanger beam 110. It should also be noted that one could increase R1 by constantly changing R2 along the length of the beam. Similarly, one could change R2 along the length of the beam to enable formation of a beam construction with non-parallel flanges, as for example, in the formation of certain intimate apparel hangers and certain top hangers as will be hereinafter discussed with respect to FIG. 6. It should also be understood that improvements in lateral stiffness and torsional stiffness can be achieved with only a single curvature, R1 or R2, although the use of both radii significantly improves stiffness.

As illustrated in FIGS. 2 and 4, the flange 110*e* is of constant width along distance L2, but expands in width along L1 and L3 to accomplish two purposes. First, it provides an offset mounting point for the fixed jaws 110*a*, 110*b* of the pinch grips 106*a*, 106*b* with respect to a center plane of the hanger, that is particularly desirable in minimizing the width of the pinch grip hangers of the present invention. Second, it allows for greater curvature of R1, which is believed to enhance resistance to lateral deflection. It is believed that both R1 and R2 contribute to resistance to lateral deflection and torsional stiffness.

In the embodiment illustrated in FIG. 1, constant radii are maintained for both R1 and R2. As noted, this is not a requirement, but does create a strong and esthetically pleasing product.

Figure 6:
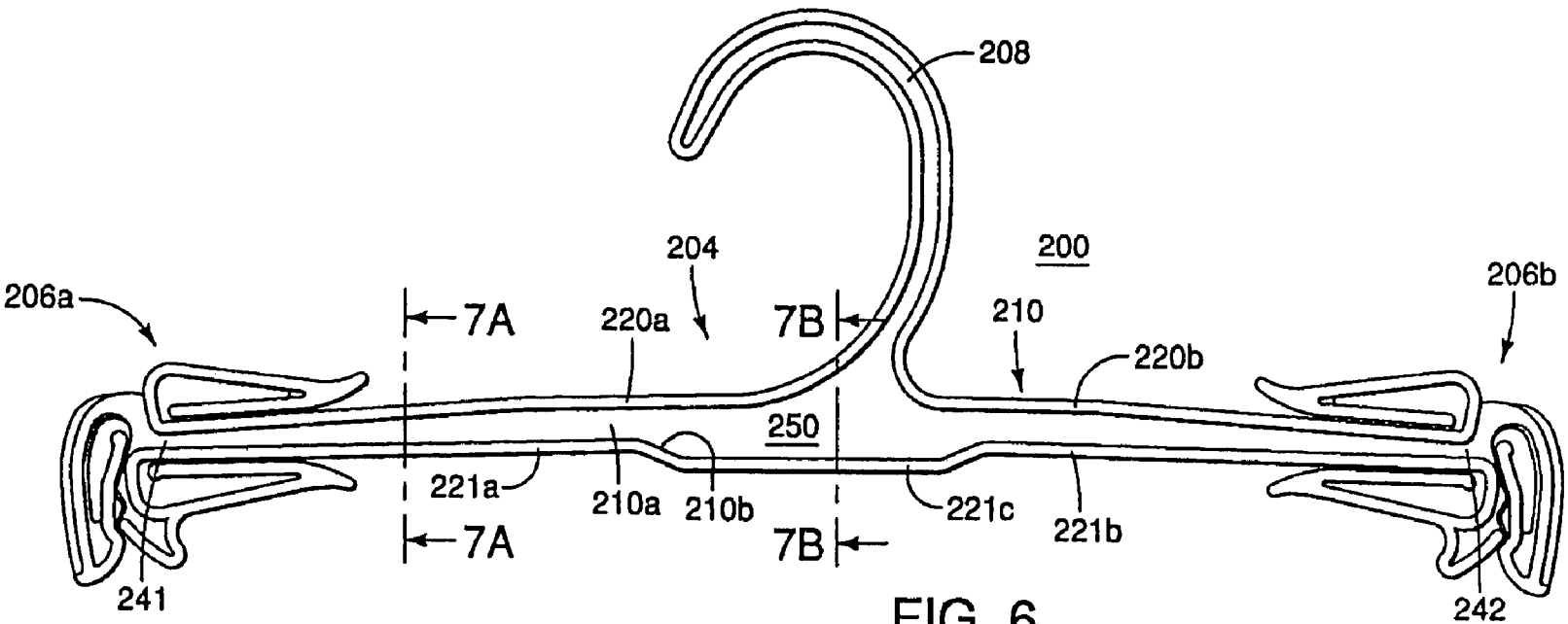
FIG. 6 is a front plan view of an intimate apparel hanger using the curved I-beam of the present invention as a body member.

FIG. 6 illustrates an intimate apparel hanger 200 that utilizes the invention with variable radii for both R1 and R2. As illustrated in FIG. 8, hanger 200 includes a hook 208 connected to a central body member 204 which supports a plurality of garment engaging clips 206*a*, 206*b* at either end thereof. The hanger is molded of plastic, preferably polystyrene or a blend thereof, and is suitable for the display of women's intimate apparel. The body member 204 includes a central beam 210 having upper first flanges 220*a*, 220*b* and lower second flanges 221*a*, 221*b* extending outward in either direction from the hook 108 to first and second ends

241, 242 which support the garment engaging clips 206*a*, 206*b*. Flanges 220*a*, 220*b* extend longitudinally outwardly from the hook 108, and may be integrally molded as continuations of flanges which form hook 108.

Body member 204 also includes an enlarged section 250 below the hook, with lower first and second flanges 221*a*, 221*b* extending outwardly from the hook to first and second ends 241, 242. The first upper flanges 220*a*, 220*b* and the lower second flanges 221*a*, 221*b* are of constant width w, as can be seen in the cross sections 7A and 7B, and are generally parallel, but with a constant non-parallel taper converging at ends 241, 242. The lower flanges 221*a*, 221*b* include a central flange 221*c* that accommodates a change in vertical height of the body under the hook 208.

Figure 7B:
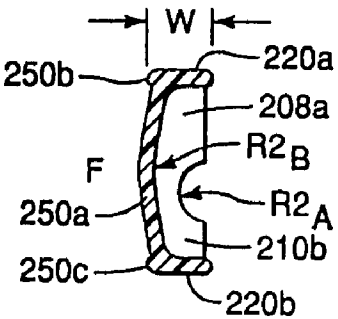
FIG. 7B illustrates a partial sectional view of the pinch-grip hanger of FIG. 6 taken along section line 7B-7B in FIG. 6.
Figure 7A:
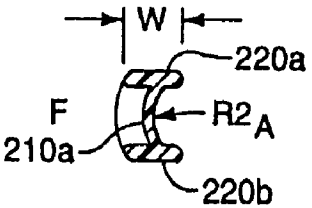
FIG. 7A illustrates a partial sectional view of the intimate apparel hanger of FIG. 6 taken along section line 7A-7A in FIG. 6.

FIG. 7A is a cross section of support beam 210 taken along section line 7A-7A in FIG. 6, while FIG. 7B is a cross section of support beam 210 taken along section line 7B-7B of FIG. 6.

As can be seen by a comparison of FIGS. 7A and 7B the radii of R1 and R2 are not constant in the hanger of FIG. 6. For example, with respect to R1, the apex of arc R1 is on the face F side of the hanger at the center body portion 250, while the apex of arc R1 has moved to the mid point of the flanges in FIG. 7A. Further, the radius R1, need not be constant, and can form a flattened section at body member 250, and curve outwardly on either side of body section 250 towards the back side of the hanger as illustrated in FIG. 7A. Likewise, with respect to R2, the radius changes from R2A at the ends 241, 242 of the hanger beam 210, to the radius R2B shown in FIG. 7B, approaching a flat surface 250*a*. For esthetic reasons, it may be desirable to form indents at 250*b*, 250*c* to mimic the edges of flanges 220*a*, 220*b* and preserve an appearance of the flanges as a continuous members through the length of body member 204. As shown in FIGS. 6 and 7B, the inner wall 208*a* of hook member 208 is visible in the cross section of FIG. 7B, as is the inner wall 210*b* of the transition from body member 250 to beam member 210.

As illustrated in FIG. 6, the hanger beam converges towards either end 241, 242 of the hanger. R2 may vary along this convergence to maintain an appearance of constant curvature, or may remain constant on either side of body member 250.

While several embodiments and variations of the present invention for a hanger beam are described in detail herein, it should be apparent that the disclosure and teachings of the present invention will suggest many alternative designs to those skilled in the art.

I claim:

1. A molded I-beam, said I-beam having first and second ends and first and second longitudinally extending flanges spaced from one another along the length of the I-beam, said beam defining a center axis along the length of the I-beam, said flanges joined by a curved web member having a first radius of curvature centered on a first axis of curvature; said curved web member extending from one side of said center axis at said first and second ends to an opposite side of said center axis, said curved web member having a second axis of curvature orthogonal to said first axis of curvature to provide enhanced resistance to flexure.

2. A molded I-beam as claimed in claim 1, wherein said first axis of curvature of said curved web of said beam defines a constant radius along the length of the curved web.

3. A molded I-beam as claimed in claim 1, wherein said second axis of curvature of said curved web is constant along the length of said curved web.

4. A molded I-beam as claimed in claim 1, wherein said first and said second axii of curvature define a constant radii along the length of the curved web.

5. A molded I-beam as claimed in claim 4, wherein said second axis of curvature defines a curved cylindrical axis, with the curvature of the cylindrical axis defined by said first axis of curvature.

6. A molded I-beam as claimed in claim 1, wherein the I-beam is molded of plastic.

* * * * *